United States Patent [19]

Matsuno et al.

[11] Patent Number: 4,501,223

[45] Date of Patent: Feb. 26, 1985

[54] COATING APPARATUS

[75] Inventors: Sadayuki Matsuno, Yokohama; Hiroshi Itoh, Tokyo; Isamu Nishikawa, Yokohama; Tatsuo Awazu, Zushi; Toshio Matsunaga, Tokyo; Yoshitaka Kitaoka; Goro Sugimoto, both of Yokohama; Hiroki Nishinaka, Amagasaki, all of Japan

[73] Assignee: Hitachi Zosen Corporation, Japan

[21] Appl. No.: 591,400

[22] Filed: Mar. 21, 1984

[30] Foreign Application Priority Data

Nov. 30, 1983 [JP] Japan ..... 58-227742
Nov. 30, 1983 [JP] Japan ..... 58-227743

[51] Int. Cl.[3] ..... B05C 7/00

[52] U.S. Cl. ..... 118/668; 118/305; 118/323

[58] Field of Search ..... 118/668, 305, 323

[56] References Cited

U.S. PATENT DOCUMENTS 2,955,568 10/1960 Blenman et al. ..... 118/323
3,286,688 11/1966 Blenman ..... 118/323
3,709,190 1/1973 Von Gottberg et al. ..... 118/323 X
3,951,092 4/1976 van den Broek ..... 118/305
4,239,431 12/1980 Dauini ..... 118/323 X
4,419,384 12/1983 Kane et al. ..... 118/323 X

FOREIGN PATENT DOCUMENTS 2025665 1/1980 United Kingdom ..... 239/159

*Primary Examiner*—Shrive P. Beck
*Attorney, Agent, or Firm*—Barnes, Kisselle, Raisch, Choate, Whittemore & Hulbert

[57] ABSTRACT

A coating apparatus comprising a support assembly, a support moving mechanism for pivotally moving the support assembly about a horizontal axis, an applicator supported by the support assembly upwardly and downwardly movably, a position detector for detecting the raised or lowered position of the applicator, a pair of distance sensors attached to the support assembly and arranged one above the other at a distance for detecting the distance from the work surface to be coated, and a control unit connected to the position detector and to the distance sensors for causing the support moving mechanism to pivotally move the support assembly in response to detection signals from one of the distance sensors closer to the applicator to hold the applicator at a substantially constant distance from the work surface. Even when curved in the direction of the height, the work surface can be coated uniformly because the substantially constant distance is maintained between the applicator and the work surface.

6 Claims, 12 Drawing Figures

* Coating Range Change

COATING APPARATUS

The present invention relates to a coating apparatus, and more particularly to a coating apparatus suitable for applying a coating composition to the shell plating of ships during docking.

Laid-Open UK patent application GB 2110647A discloses a coating apparatus including support means which is mounted on a running truck horizontally movable along the surface to be treated and which supports an applicator upwardly or downwardly movably. The support means is pivotally movable about a horizontal axis by a device which is controlled by an operator, whereby the applicator can be held somewhat at a constant distance from the work surface which is curved in the direction of height. While being reciprocated between an upper limit position and a lower limit position, the applicator sprays a coating composition onto the work surface for coating.

However, because the support means moving device is operated by the worker, the known coating apparatus requires skill in holding the applicator at a constant distance from the work surface, while even a skilled worker has difficulties in maintaining the constant distance at all times between the work surface and the applicator which is continuously moved upward and downward, thus failing to assure uniform coating.

An object of the present invention is to provide an apparatus by which even curved surfaces can be coated uniformly and full-automatically.

To fulfill this object, the present invention provides a coating apparatus comprising support means, support moving means for pivotally moving the support means about a horizontal axis, an applicator holder supported by the support means upwardly and downwardly movably and supporting applicator means, holder drive means for moving the applicator holder upward and downward, position detecting means for detecting the raised or lowered position of the applicator holder or the applicator means, a pair of distance detecting means attached to the support means and arranged one above the other at a distance for detecting the distance from the work surface to be coated, and control means connected to the position detecting means and to the distance detecting means for causing the support moving means to pivotally move the support means in response to detection signals from one of the distance detecting means closer to the applicator means to maintain a substantially constant distance between the applicator means and the work surface.

Various features and advantages of the present invention will be readily understood from the embodiments to be described below with reference to the accompanying drawings, in which.

Figure 1:
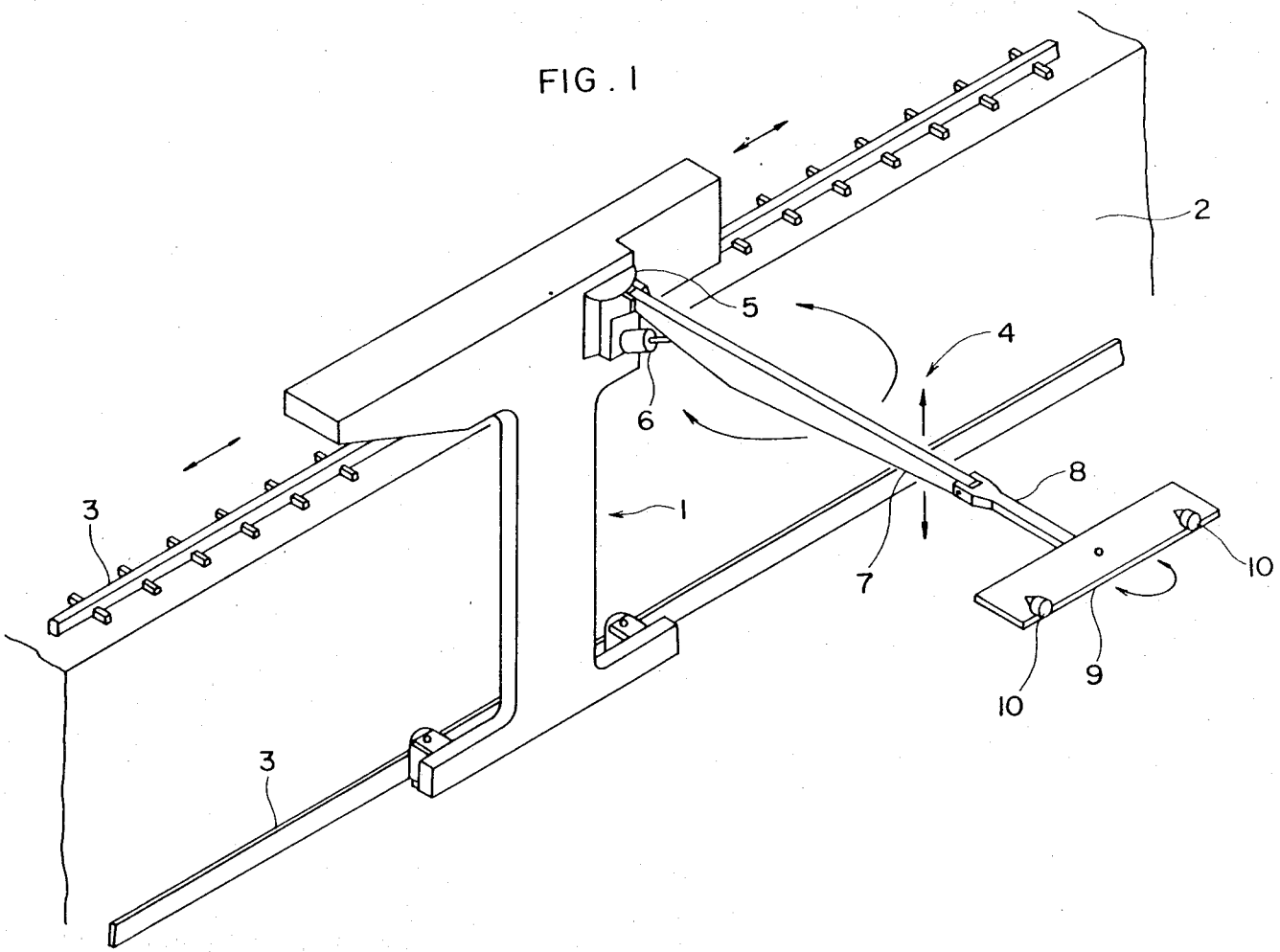
FIG. 1 is an overall perspective view showing a coating apparatus embodying the invention.
Figure 2:
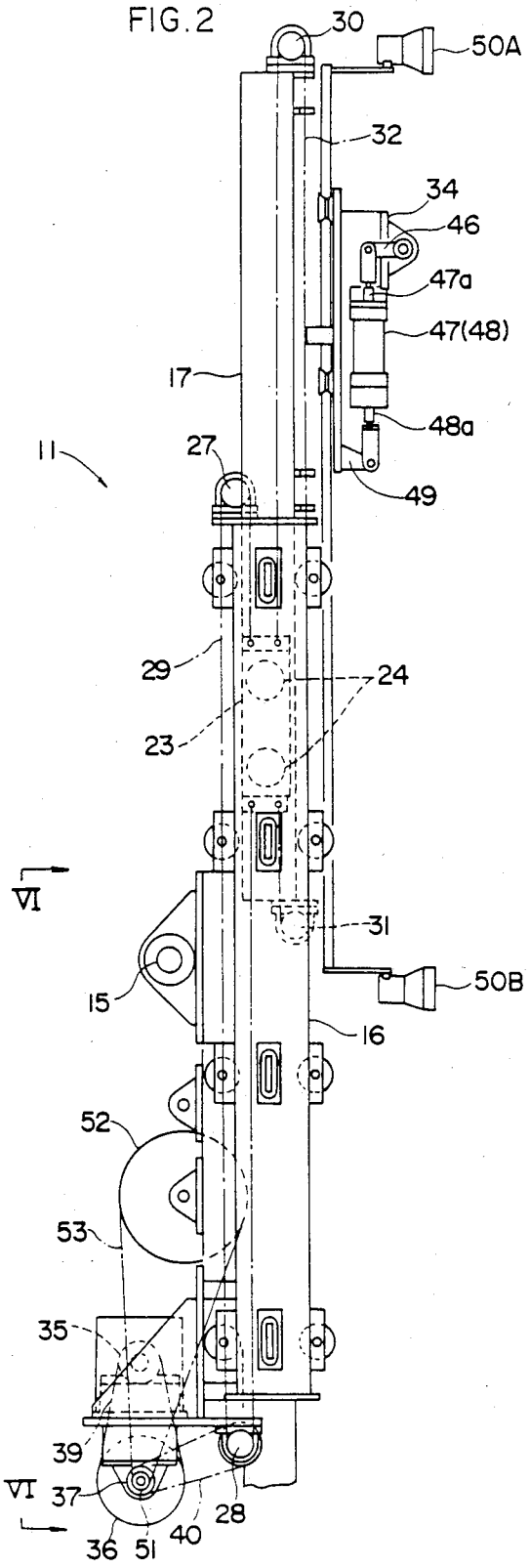
FIG. 2 is a side elevation showing support means included in the coating apparatus and provided with an applicator.
Figure 3:
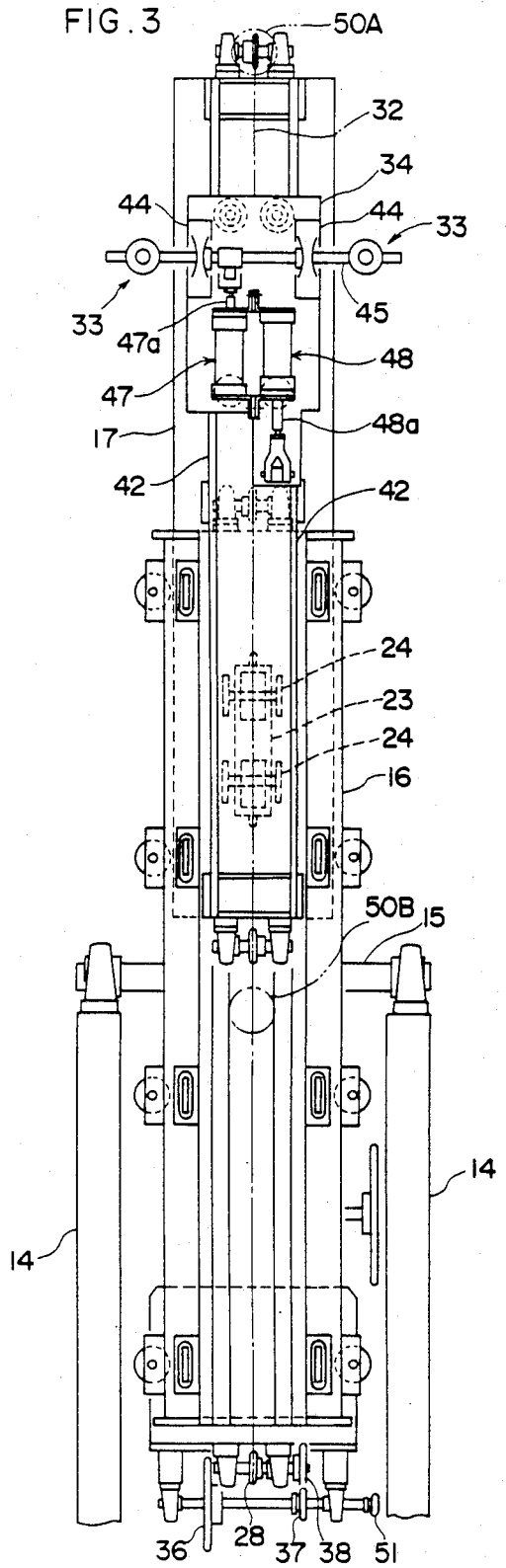
FIG. 3 is a front view showing the support means.
Figure 4:
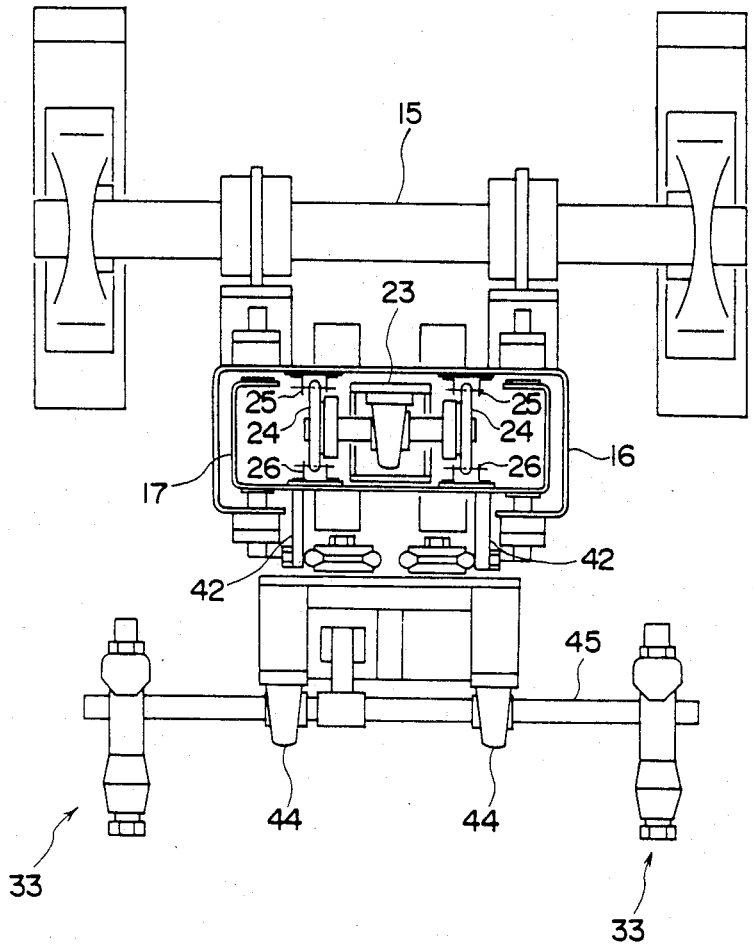
FIG. 4 is a plan view of the support means.
Figure 5:
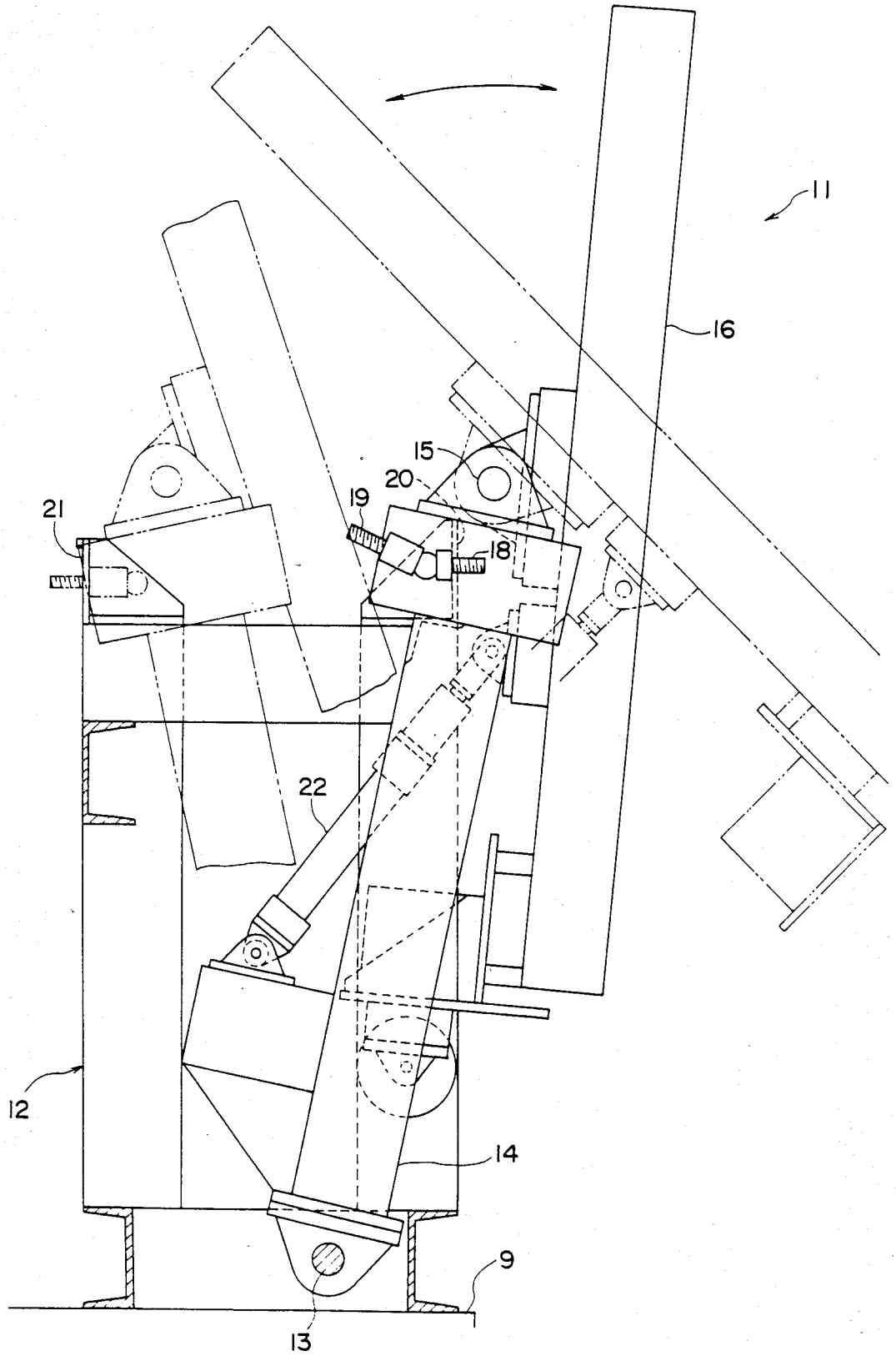
FIG. 5 is a fragmentary enlarged view of the support means.

With reference to FIG. 1, a truck 1 is adapted to run horizontally alongside a hull in a dock over the entire length of the hull by being guided by upper and lower rails 3 extending along a side wall 2 of the dock. The running truck 1 is provided with a crane 4. The crane 4 comprises a rotary support 5 mounted on an upper portion of the truck 1 and rotatable about a vertical axis, a pivotal arm 7 supported by the rotary support 5 and pivotally movable about a horizontal axis by a hydraulic cylinder 6, and a rotatable plate 9 supported by a horizontal arm 8 which is held always in a horizontal position to the free end of the pivotal arm 7, the plate 9 being rotatable about a vertical axis. Ultrasonic sensors 10 mounted on opposite ends of the rotatable plate 9 are used for causing the plate 9 to follow the horizontal curve of the outer side surface of the hull.

With reference to FIGS. 2 to 8, support means 11 is mounted on the rotatable plate 9. The support means 11 chiefly comprises a pair of pivotal rods 14 rotatably attached by a horizontal pivot 13 to opposite sides of the lower end of a frame 12 fixedly mounted on the rotatable plate 9, a first support member 16 rotatably connected to the free ends of the pivotal rods 14 by a horizontal pivot 15 and in the form of a channel member which is elongated generally vertically, and a second support member 17 supported by the first support member 16 movably longitudinally thereof and similarly in the form of a channel member which is elongated generally vertically.

Each of the pivotal rods 14 is fixedly provided at its upper end with a front bolt 18 and a rear bolt 19 which extend away from each other. When the front bolt 18 is inserted through a hole formed in a front bracket 20 at the upper end of the frame 12, with an unillustrated nut screwed on the bolt, the pivotal rod 14 can be retained in a forwardly inclined position (shown in solid lines in FIG. 5). When the rear bolt 19 is inserted through a hole formed in a rear bracket 21 at the upper end of the frame 12, with an unillustrated nut screwed on the bolt, the pivotal rod 14 can be held in a rearwardly inclined position (shown in phantom lines in FIG. 5).

A hydraulic cylinder 22 is provided between the pivotal rod 14 and the first support member 16. The first support member 16 is pivotally movable with the second support member 17 by operating the hydraulic cylinder 22.

Figure 7:
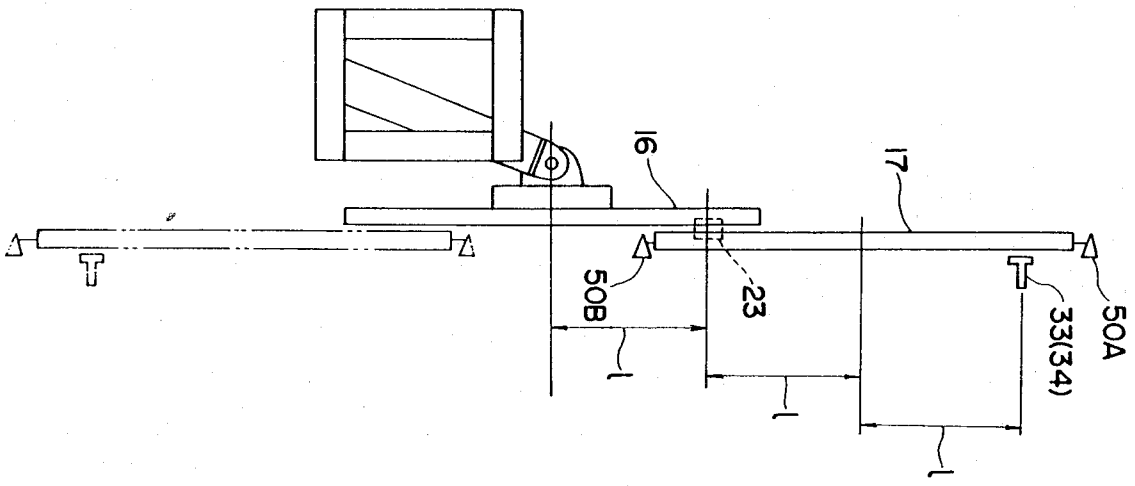
FIG. 7 is a diagram for illustrating the upward or downward movement of the applicator.

A movable member 23 is provided between the first support member 16 and the second support member 17 and has engaging wheels (such as sprockets) 24. First and second engaging rails 25, 26 are attached to the opposed faces of the support members 15, 16, respectively. The engaging wheels 24 on the movable member 23 are in engagement with these rails 25, 26. Connected to opposite ends of the movable member 23 are a first roller chain 29 which is reeved around sprockets 27, 28 mounted on opposite ends of the first support member 16 and a second roller chain 32 which is reeved around sprockets 30, 31 on opposite ends of the second support member 17. The second roller chain 32 is connected also to an applicator holder 32 carrying applicators 33. The sprocket 28 at the lower end of the first support 16 is coupled through sprockets 35 to 38 and chains 39, 40 to a hydraulic motor 41 fixed to the first support member 16. Accordingly when the motor 41 moves the movable member 23 a distance l relative to the first support member 16 as seen in FIG. 7, the second support member 17 moves the same distance l in the same direction relative to the movable member 23, and at the same time, the holder 34, i.e., the applicator 33 attached thereto, move the same distance l in the same direction relative to the second support member 17. In other words, the applicators 33 move three times the distance of movement of the movable member 23.

The holder 34 is movable along a pair of guide rails 42 fixed to the second support member 17. The applicators 33 (such as spray guns for a coating composition) are fixed to a horizontal rotary shaft 45 supported by bearings 44 on the holder 34. A first air cylinder 47 has a piston rod 47a which is connected to the rotary shaft 45 by a link 46. Fixed to the first air cylinder 47 is a second air cylinder 48 having a piston rod 48*a* which extends in a direction opposite to the piston rod 47*a*. The piston rod 48*a* is rotatably connected to a bracket 49 on the holder 34. The applicators 33 are adapted to be brought to their pivoted central position when the piston rod 47*a* of the first air cylinder 47 is retracted, with the piston rod 48*a* of the second air cylinder 48 extended. Accordingly, when the piston rod 47*a* of the first cylinder 47 is extended, the applicators 33 are pivoted downward, while the retraction of the piston rod 48*a* of the second cylinder 48 pivotally moves the applicators 33 upward.

Figure 6:
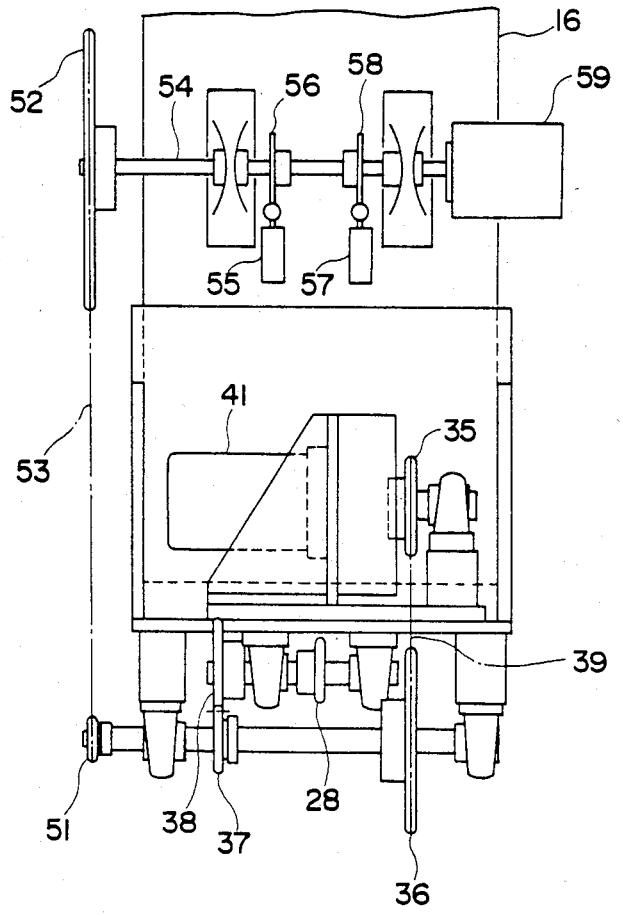
FIG. 6 is a view showing the support means as it is seen in the direction of line VI—VI in FIG. 2.

Upper and lower ultrasonic sensors 50A, 50B for detecting the distance from the side outer surface of the hull (work surface to be coated) are attached to the upper and lower ends of the second support member 17. Further as seen in FIG. 6, the first support member 16 is provided with an input shaft 54 which is coupled through sprockets 51, 52 and a chain 53 to the hydraulic motor 41 for moving the movable member 23 upward or downward. The sprocket 51 is driven by the motor 41 through the sprockets 35, 36 and chain 39. Mounted on the midportion of the input shaft 54 are a first cam plate 56 for actuating a first limit switch 55 for detecting that the applicators 33 are positioned above the central position in the range of travel thereof, and a second cam plate 58 for actuating a second limit switch 57 for detecting that the applicators 33 are below the central position. A rotary encoder 59 is mounted on one end of the input shaft 54 for detecting the position of the applicator 33 during the travel thereof.

Figure 8:
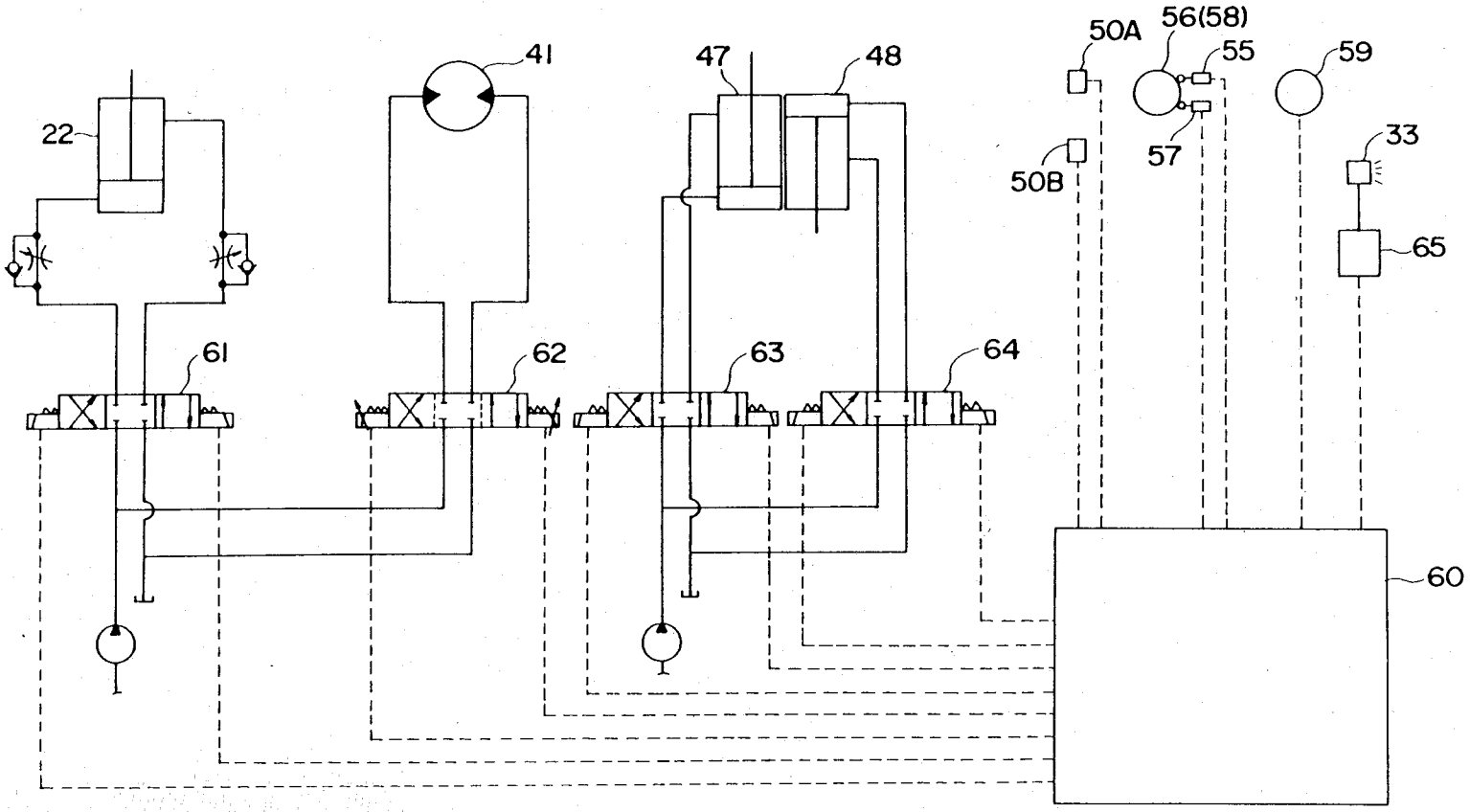
FIG. 8 is a diagram showing the control circuit of the coating apparatus.

As seen in FIG. 8, the signals from the sensors 50A, 50B, the limit switches 55, 57 and the encoder 59 are all fed to a central processing unit (CPU) 60. In response to such signals, the CPU 60 controls the hydraulic cylinder 22, hydraulic motor 41, air cylinder 47 and air cylinder 48 via electromagnetic change-over valves 61 to 64, respectively, and also controls a coating composition feeder 65 for the applicators 33.

With the coating apparatus of the above construction, the first support member 16, namely, the support means 11, is controlled by the hydraulic cylinder 22 in the following manner. The first and second limit switches 55, 57 feed signals to the CPU 60, which checks whether the applicators 33 are positioned above or below the central position of the path of travel thereof. For example when the applicators 33 are positioned above the central position, the distance signal from the first sensor 50A is compared with a preset distance value. For example if they are found to be away from the hull side outer surface by too large a distance, a signal is given to the electromagnetic change-over valve 61 of the cylinder 22 to bring the first sensor 50A, i.e., the applicators 33, to a position at the preset distance from the outer surface, whereby the means 11 is inclined forward. If the applicators 33 are positioned too close to the hull outer surface, a signal is of course delivered to the valve 61 for moving them away from the hull. Further when the applicators 33 are located below the central position, the second sensor 50B functions to control the support means in the same manner as above. In this way, a substantially constant distance is maintained between the applicators 33 and the side outer surface of the hull over the entire path of travel of the applicators. This eliminates irregularities in the coating that could result from variations in the spraying distance.

Figure 9:
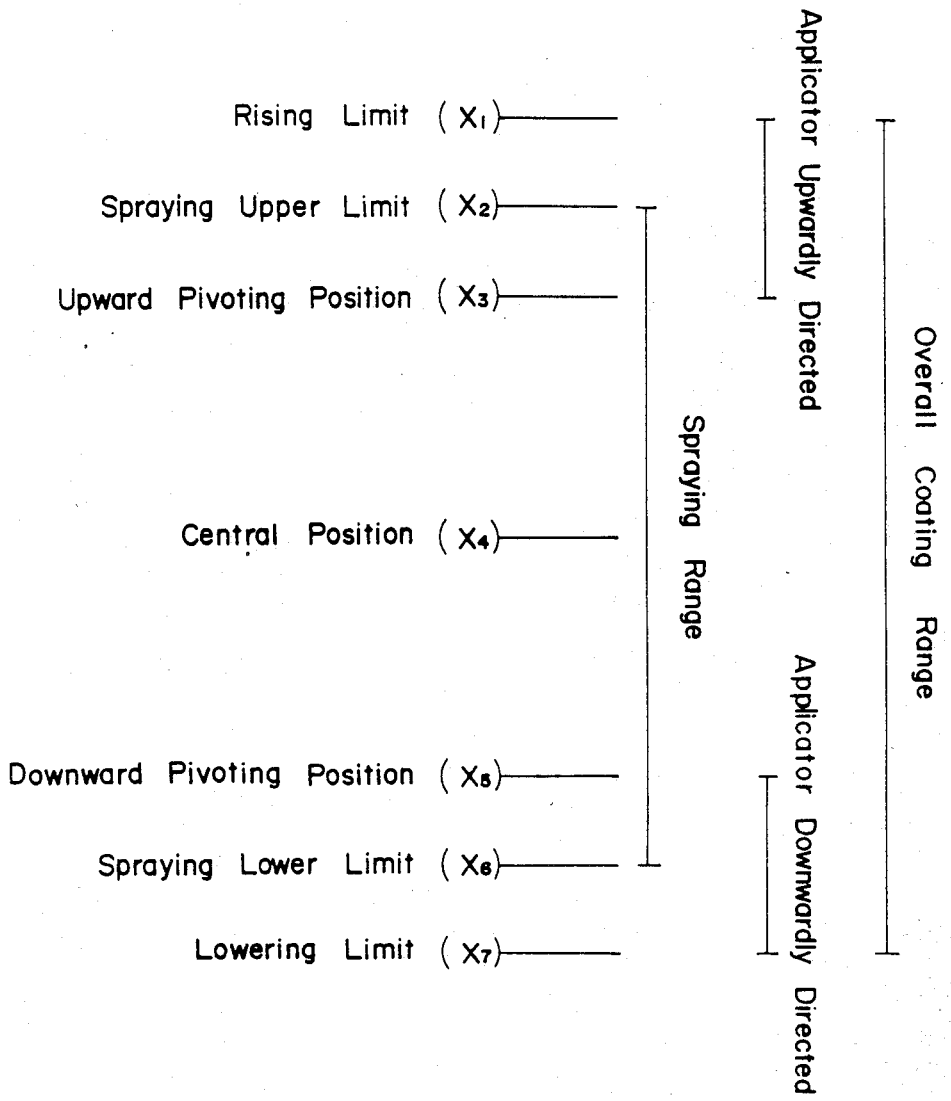
FIG. 9 is a diagram showing operating positions of the applicator.

The pivotal movement of the applicators 33 is controlled in the manner to be described below with reference to FIG. 9. Along the path of upward-downward movement of the applicators 33, rising limit position, spraying upper limit position, upward pivoting position, central position, downward pivoting position, spraying lower limit position and lowering limit position are set for the applicators from above downward in the order mentioned. Encoded values corresponding to these positions are stored in a memory of the CPU 60 as X1 to X7. Under the control of the CPU 60, a coating composition is sprayed from the applicators 33 within the range of X2 to X6. Between X1 and X3, the applicators 33 are directed upward within an upward angular range of 45 degrees. Between X5 and X7, the applicators 33 are directed upward within a downward angular range of 45 degrees. The applicators 33 are operated in this mode by controlling the hydraulic motor 41, the air cylinders 47, 48 and the composition feeder 65. Accordingly, between X2 and X3, as well as between X5 and X6, the coating composition is sprayed from the applicators 33 while they are being pivoted at all times. The coating composition is therefore applicable uniformly over the entire coating range without producing any coat of increased thickness in the vicinity of the rising upper limit position or the lowering limit position.

Figure 10:
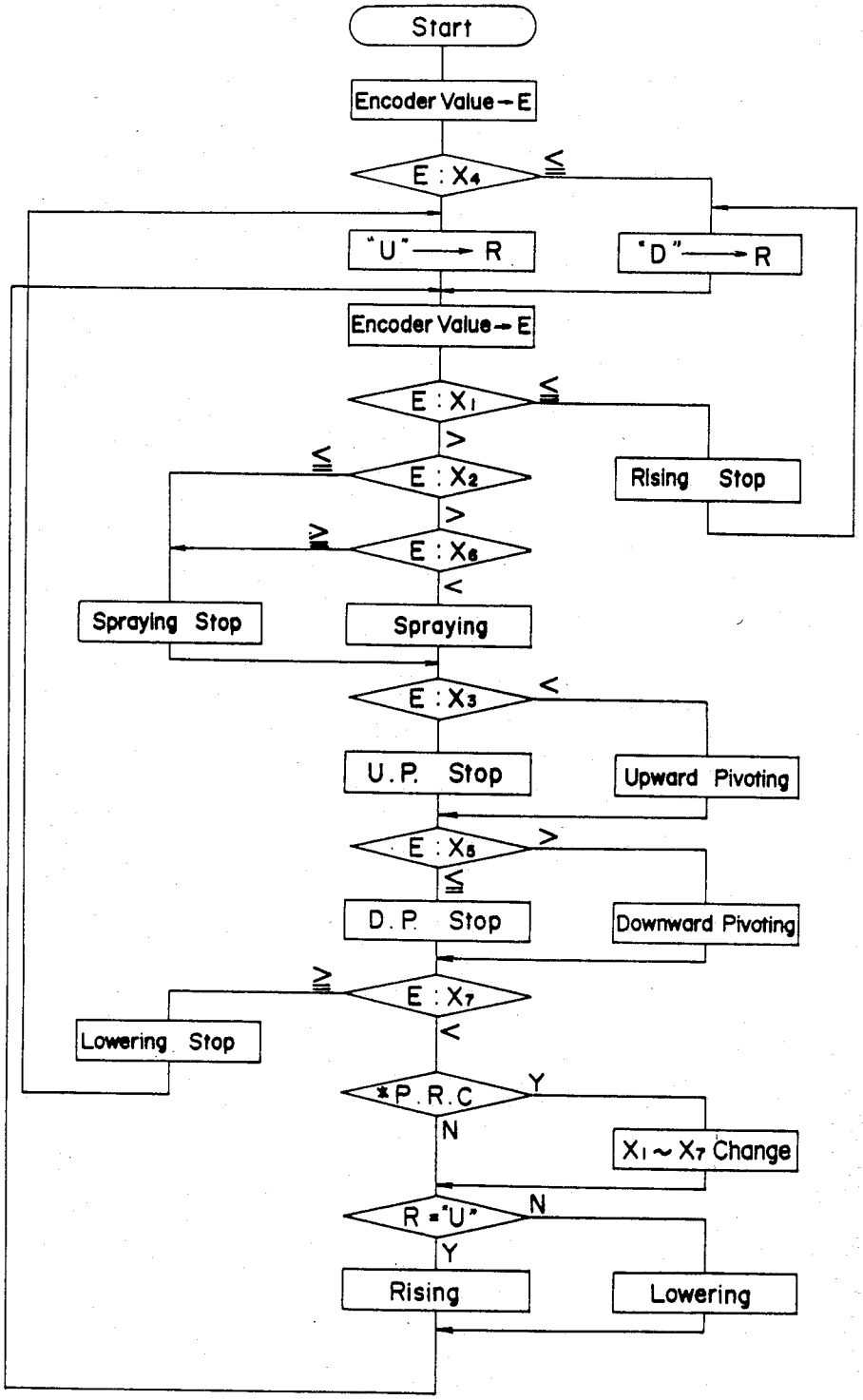
FIG. 10 is a flow chart showing a control process for coating operation.
Figure 11:
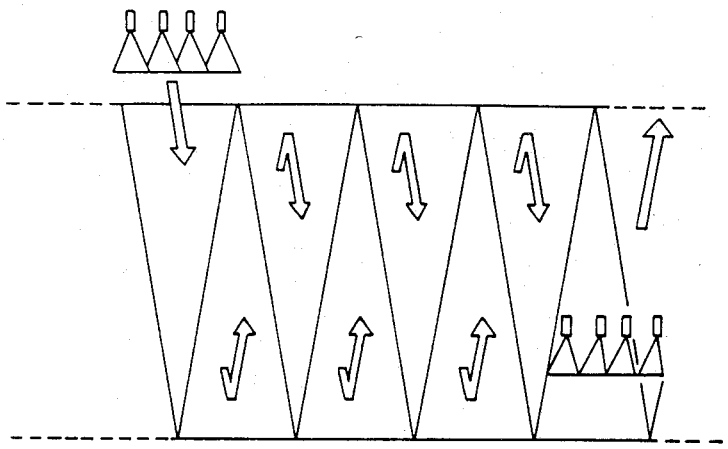
FIG. 11 is a diagram showing coating cycles.

Actual coating sequence will be described below chiefly with reference to FIGS. 9 and 10. When the start button (not shown) is depressed, an encoder value E representing the position where the applicators 33 are then located is fed to the CPU 60 and compared with X4. If the encorder value E is greater than X4, i.e., if the applicators are positioned below the central position, an instruction for lowering mode D is set in a register R in the CPU 60, causing the applicator 33 to start lowering. When the position of the applicators 33, i.e., the encorder value E, is in the range of X2 to X6, a signal is given to the feeder 65 to initiate application of the coating composition. During the descent of the applicators 33, the encoder value E matches X5, whereupon the CPU 60 feeds to the first air cylinder 47 a signal for pivoting the applicators 33 downward. The applicators 33 are pivotally moved downward from the usual coating posture. When the encoder value E thereafter matches X6, a coating intrruption signal is sent to the feeder 65 to discontinue the coating operation. The applicators 33 further reach the lowering limit position, with a match between the encoder value E and X7, whereupon a stop signal is emitted to discontinue the decent and downward pivotal movement of the applicators 33. The mode now changes to rising mode U, whereupon the applicators 33 start to rise and are pivoted upward by the first air cylinder 47 (although still directed downward). When the encoder value E becomes identical with X6, coating operation is resumed. As the applicators 33 further rise, the encoder value E matches X5. The applicators 33 are returned to the usual coating posture and brought out of pivotal movement. In this state, the applicators 33 rise to the position of X3 while spraying the composition. At the position of X3, the CPU 60 emits a signal for operating the second cylinder 48, initiating the applicators 33 into upward pivotal movement. At the position of X2, the coating operation is discontinued, and at the position of X1, the applicators 33 stop rising and moving pivotally upward. The applicators 33 thereafter start to descend again in the same manner as above for continual coating operation. While the applicators 33 move upward and downward in reciprocation, the truck 1 (FIG. 1) carrying the support means 11 on the crane 4 continuously moves horizontally. Accordingly the applicators 33 spray the composition in a zigzag fashion as seen in FIG. 11 (showing four spray guns).

Based on the distance measured by the sensors 10 (FIG. 1), the applicators 33 are caused to follow the curve of the outer surface of the hull longitudinally thereof by the crane 4, which is controlled of course by the CPU 60 or other control means connected to the CPU 60.

Figure 12:
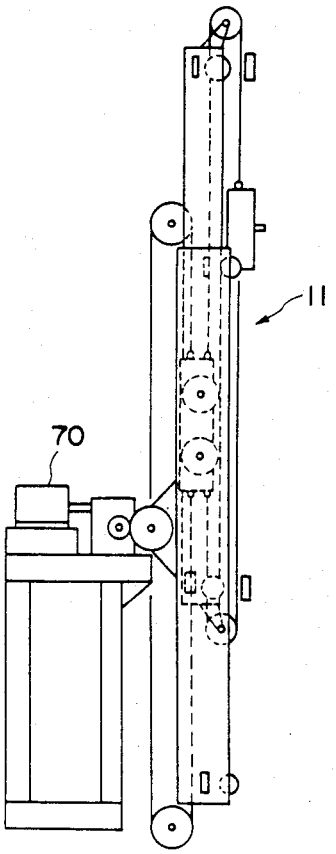
FIG. 12 is a fragmentary side elevation showing another embodiment of the invention.

The support means 11 may be pivoted by a hydraulic or electric stepping motor 70 as shown in FIG. 12.

What is claimed is:

1. A coating apparatus comprising support means, support moving means for pivotally moving the support means about a horizontal axis, an applicator holder supported by the support means upwardly and downwardly movably and supporting applicator means, holder drive means for moving the applicator holder upward and downward, position detecting means for detecting the raised or lowered position of the applicator holder or the applicator means, a pair of distance detecting means attached to the support means and arranged one above the other at a distance for detecting the distance from the work surface to be coated, and control means connected to the position detecting means and to the distance detecting means for causing the support moving means to pivotally move the support means in response to detection signals from one of the distance detecting means closer to the applicator means to maintain a substantially constant distance between the applicator means and the work surface.

2. A coating apparatus as defined in claim 1 wherein the applicator means is mounted on the holder and pivotable about a horizontal axis by applicator pivoting means, the control means being adapted to cause the pivoting means to pivotally move the applicator means upward upon the applicator means reaching a predetermined raised position and to cause the pivoting means to pivotally move the applicator means downward upon the applicator means reaching a predetermined lowered position.

3. A coating apparatus as defined in claim 1 wherein the position detecting means comprises a rotary encoder coupled to the holder drive means.

4. A coating apparatus as defined in claim 1 wherein the support means comprises a first support member elongated in the upward-downward direction and having first engaging rail means and a second support member supported by the first support member movably longitudinally thereof and having second engaging rail means in opposed relation to the first engaging rail means, the applicator means being supported by the second support member upwardly and downwardly movably, the holder drive means including a movable member having engaging wheel means engageable with the two rail means without sliding, means for moving the second support member relative to the movable member by moving the movable member relative to the first support member and means for converting the movement of the second support member relative to the movable member to a movement, equivalent thereto in distance and direction, of the applicator means relative to the second support member.

5. A coating apparatus as defined in claim 1 wherein the support means is attached by a crane to a running truck movable horizontally, and the crane comprises a rotary support mounted on the running truck rotatably about a vertical axis, a pivotal arm having one end supported by the rotary support rotatably about a horizontal axis and pivotally movable by cylinder means, a horizontal arm connected at its one end to the other end of the pivotal arm rotatably about a horizontal axis and held in a horizontal position at all times and a rotatable plate connected to the other end of the horizontal arm rotatably about a vertical axis and having the support means mounted thereon.

6. A coating apparatus as defined in claim 5 wherein the rotatable plate is provided at its opposite ends with a pair of distance detecting means for detecting the distance between the rotatable plate and the work surface.

* * * * *